United States Patent [19]

Sumner

[11] 4,038,830

[45] Aug. 2, 1977

[54] MODULAR GEOMETRIC OFFSHORE STRUCTURES SYSTEM

[76] Inventor: Maurice N. Sumner, 1718 Lubbock, Houston, Tex. 77007

[21] Appl. No.: 565,860

[22] Filed: Apr. 7, 1975

Related U.S. Application Data

[60] Continuation-in-part of Ser. No. 539,301, Jan. 8, 1975, which is a division of Ser. No. 243,790, April 13, 1972, Pat. No. 3,874,180, which is a continuation-in-part of Ser. No. 107,288, Jan. 18, 1971, Pat. No. 3,716,993, which is a continuation-in-part of Ser. No. 649,889, June 29, 1967, Pat. No. 3,575,005.

[51] Int. Cl.[2] ..... E02B 17/00

[52] U.S. Cl. ..... 61/89; 61/53.5; 61/48; 114/219

[58] Field of Search ..... 61/46.5, 46, 53.5, 89

[56] References Cited

U.S. PATENT DOCUMENTS

| | | | |
|---|---|---|---|
| 1,908,714 | 5/1933 | Schneider | 61/46.5 X |
| 2,908,141 | 10/1959 | Marsh | 61/46.5 |
| 2,968,930 | 1/1961 | Mangone | 61/46.5 |
| 3,429,133 | 2/1969 | Hauber | 61/46.5 |
| 3,486,343 | 12/1969 | Gibson et al. | 61/46.5 |
| 3,638,436 | 2/1972 | Pogonowski | 61/46.5 |
| 3,643,447 | 2/1972 | Pogonowski | 61/46 |
| 3,645,104 | 2/1972 | Hogan | 61/46.5 |
| 3,668,876 | 6/1972 | Kohler | 61/46.5 |
| 3,754,403 | 8/1973 | Mott et al. | 61/46.5 |

*Primary Examiner*—Jacob Shapiro
*Attorney, Agent, or Firm*—Kenneth H. Johnson

[57] ABSTRACT

A modular system of offshore structures having one or more hyperboloidal structures which are adapted to cooperate with a variety of ringlike foundation elements, for example by mooring or rigid attachment. The hyperboloidal structure comprise pile arrays, frames and shells. Hyperboloidal pile array structures are composed of members which conform to the downward clockwise and counterclockwise ruling on a hyperboloid of revolution of one sheet, thereby providing useful attachment means to the marine floor, which has resistance to scouring and provide both tension and compressive resistance to the force of the sea. The hyperboloid shells are broad at the base for support and on the top to provide a large work area and when optimally placed, they are narrow at the water surface where the greatest environmental impact occurs.

7 Claims, 52 Drawing Figures

MODULAR GEOMETRIC OFFSHORE STRUCTURES SYSTEM

CROSS-REFERENCES

This application is a continuation-in-part of Ser. No. 539,301 filed Jan. 8, 1975, which is a division of application Ser. No. 243,790, filed Apr. 13, 1972, now U.S. Pat. No. 3,874,180, which is a continuation-in-part of application Ser. No. 107,288, filed Jan. 18, 1971, now U.S. Pat. No. 3,716,993, which is a continuation-in-part of application Ser. No. 649,889, filed June 29, 1967, now U.S. Pat. 3,575,005.

BACKGROUND OF THE INVENTION

There is in the offshore drilling, production, and transportation industry a variety of structures for supporting men and machinery at stations offshore. The structures are similar in basic function, namely to support the men and machinery in accomplishing their assigned functions. Otherwise the structures are significantly different in that some are mobile while others are stationary; and some are founded on the marine floor while others float. The mobile structures are commonly called "mobile rigs" while the fixed ones are "fixed platforms." These rigs and platforms are generally classified as either drill ships, semi-submersibles, submersibles, jackups, pile jackets, or one of a few other hybrid designs, Each is peculiarly designed and adapted for a fairly limited set of operational conditions. As a result, there is restrictive flexibility of use. For example, the fixed frame design, commonly known as the aforementioned pile jacket, is best suited for permanent stations in water of a few hundred feet or less. All other current types are mobile and more expensive as a result, and therefore they are well suited for exploration work, but not so well suited for long duration stationary production work. However, even production work is not truly permanent and reusability would be a significant consideration in the design of a rig for production purposes. Fixed platforms are seldom used in exploration work because the cost of building a new platform for each exploratory hole is almost prohibitive, except in shallow, protected waters. Thus fixed platforms are primarily production type structures.

In contrast to the permanent station characterizing the fixed fram design, the most mobile type of offshore platform is the drill ship with its appropriate stabilizing and stationing apparatus such as thrusters, anchors and winches. The ship certainly is not best suited for permanent stationing because it is particularly sensitive to wave action by reason of the wide surface area of structure exposed to the water, and the use of thrusters to maintain stationing for long periods of time, as would be necessary for production activities, is economically unfeasible because of fuel consumption and the necessarily continuous human monitoring which is required. Also, of course, the ship is vulnerable to storms and generally adverse conditions.

Intermediate the permanent station characterizing the fixed frame and the high mobility of the drill ship are the family of rigs known as jackups. The jackup rig has some of the advantages of both the fixed frame and the drill ship. It is analogous to the former in that it is supported on the marine floor, and therefore is quite stable and requires no continuous operation or monitoring to maintain position. And, when the legs are raised, it can be towed from place to place so as to thereby provide a degree of mobility analogous to the drill ship. The legs can, of course be lowered to varying elevations so as to provide the jackup with an adaptability to a variety of depths.

The aforementioned submersibles are also on intermediate form of rig. The submersibles and also the semi-submersibles have good stability, each is suited to its depth, the semi-submersible to deep water, the submersible bottom-founded frame to shallow water. Both are more stable but less mobile than the drill ship. They cannot be moved in heavy weather without jeopardy to themselves, their crew, and the towing vessel; and indeed some have even been lost while being moved in calm waters. The multiplicity of columns with the connecting framework give rise to the vulnerability to heavy weather.

By far the most common structure known in the art is the pile jacket or pile template, which, when installed, comprises a number of slightly inclined tubular legs, longer than the water depth, braced together into a unitary frame by a number of planform plane frames and portal braces in *x*'s, *v*'s, *k*'s, or diagonals and having mud mats at the base and piling driven through and secured to the legs. Such a structure might be installed by hauling its entirety from the place of assembly to the place of use, settling it to the bottom to rest temporarily on its mud mats, driving the piles through the legs, and securing them thereto. It is plain that the mud mats are necessary to install the structure, since they hold it in place during installation, and it is also true that such a structure will only be well adapted to a single depth of water. If it were to be placed in water of a lesser depth, its top might be inconveniently high above the water, or it might be refabricated to other dimensions to avoid this. If an attempt were made to found it deeper water, as by holding it in place by other means than its mud mats, keeping its top at a convenient elevation, and letting its piles project down past its bottom, these piles would likely be too limber and weak in bending to support the structure; not that a similar weakness can result if a portion of the mud washes or scours away by motion of the water past a normally-installed platform.

It is also apparent that the number, spacing and diameter of the legs of a typical pile jacket is determined by the number, spacing, and diameter of the piles required to support the anticipated loads. One skilled in the structural arts might offer many ways to have fewer and smaller legs and braces than are found in pile jackets, but if the concept of the pile jacket of the prior art is retained then the advantages of having fewer and smaller legs and braces cannot be obtained because for every pile there must be a leg and for every leg there must be a brace.

So, in summary, a pile jacket is not well adapted to a wide range of water depths and is therefore not well adapted to be portable because its base is employed in its erection; if new methods were found to omit this employment of the base, and thereby omit the base, and therewith a lower portion of the framework, these new methods could not be employed anyway, because the piling could not withstand the bending effects resulting from their greater exposed substantially parallel length.

These problems of the pile jacket are particularly aggravated in deep water.

Another structure of the prior art is the moored floating structure held fixed by cables to an anchor structure, it is inherently well adapted to deep water; anchorage has not been applied in practice due to a lack of satisfactory anchor structure, and due to the awkward upper structures of the prior art.

It thus becomes evident without further elaboration that each of the various types of offshore rigs commonly used is well suited only to a relatively narrow range of operation. As a result, a company or firm which chooses to operate offshore must elect the particular type of rig best suited for its contemplated initial endeavor and thereafter be committed to the limitations of that rig when it is used in subsequent drilling operations.

The limitations inherent in the state of the art are best illustrated by a brief examination of one of the more common types of mobile rig. The jackup rig, as previously noted, has certain of the advantageous characteristics of the pile jacket in that it is founded on the bottom in a stable way while the apparatus it carries is supported clear of the highest anticipated waves so that the whole is fairly stable semi-permanent, albeit expensive, station. Mobility is achieved by lowering its bouyant platform to the water, and raising the legs from the marine floor, so that the whole can then be floatably moved to another location. Although jackup rigs in general are adapted to a relatively wide range of operating depths, namely about 20 to perhaps 500 feet, any single jackup is adapted, as a practical matter, to a very limited subrange within this range. For example, if a jackup of the prior art were to be designed for work in the Gulf of Mexico in water of 200 foot depth, it certainly could not work in depths of 400 feet because its legs would not reach the bottom. Likewise, it could not work competitively, that is economically, in water depths of say 60 feet because other less expensive jackup rigs would be availiable for that work. So, although in a physical sense jackup rigs can work in a wide range of depths, they cannot in an individual and in an economic sense encompass a very large range of usefulness.

Therefore, it might be concluded from the above brief discussion that the offshore operator is restricted to a fixed location rig which represents a substantial investment, or to a mobile rig which represents a very substantial investment but which is adapted only to a relatively narrow range of operational depths which may represent a certain class of locations.

SUMMARY OF THE INVENTION

Briefly, the present invention envisions a modular system of offshore structures having one or more hyperboloidal or other geometric structures or vessels which are in circumstances adapted to co-operate with a variety of ringlike foundation elements, as by mooring or rigid attachment. Releasable connection means is envisioned, and so are pile means to found the foundation ring.

A feature and advantage of the invention resides in the geometric vessels, which have previously unknown advantages offshore; advantages of new kind and new degree, including:

a. safer floatability and safer statonability
b. diminished wave resistance
c. improved inherent stability and mobility
d. resistance to corrosion and erosion and impact
e. inherent environmental protection
f. simplicity of analysis and of fabrication and erection
g. economy of weight, of time, of cost, and of means
h. breadth of application Other features and advantages reside in means a. to moor quickly and safely
b. to place foundation structure, particularly piles
c. to receive, store, and distribute petroleum The above and numerous other features and advantages of the invention will become apparent from the following detailed description, claims, and drawings.

DRAWINGS

FIG. 7 shows use of the structure for production from the completed well while further drilling is carried on;

DETAILED DESCRIPTION OF THE INVENTION

Figure 1:
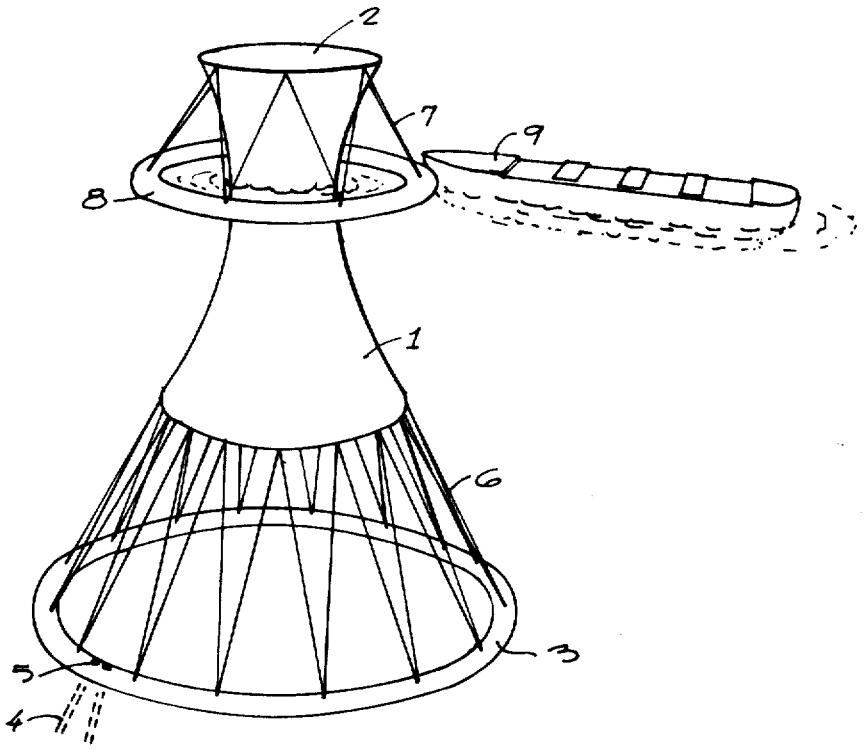
FIG. 1 is a perspective view of a preferred embodiment of this invention.

In FIG. 1 the shell 1 is a ferro-cemiento in the form of hyperboloid of revolution of one sheet, whth a domical shell 2 blocking its throat for buoyancy. The bell-like structure formed by the two shells 1 and 2 is itself a single buoyant shell of revolution and is partly filled with air below the shell 2, thus buoying up the entire structure. The anchor ring 3 sits on the marine floor, and is held there by piles 4 in bipodal array through guide and holding means 5 in the ring 3. Moorings 6 in hyperboloidal array from the shell 1 to the ring 3 hold the floating shells 1 and 2 fixedly down in the water. Suspenders 7 in hyperboloidal array hold the bumper ring 8 stably and protectively around the shell 1. The ship 9 therefore can moor to the ring 8, and not damage by the shell structure 1 in case of heavy seas.

Figure 2:
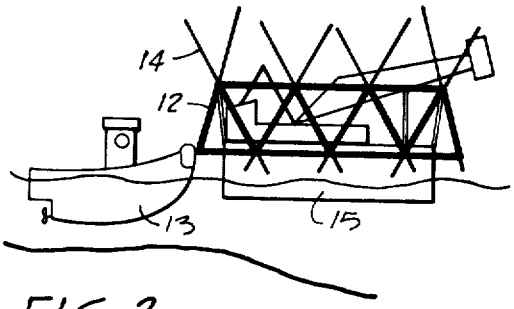
FIG. 2 is the first of a number of view illustrating the method of the present invention applied to a new vessel and structure.
Figure 3:
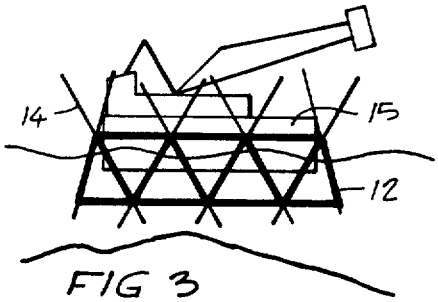
FIG. 3 illustrates the step of preparation for driving the pilings into the subsoil.

Attention is next directed to FIG. 2 of the drawings which illustrates a structure 12 releasably secured to a vessel 15. A plurality of pilings 14 carried in the structure 12 extend through the framing of the structure. The vessel 15 is preferably a buoyant body with drilling rig. Releasable securing means such as shock absorbers, fenders, or ropes join the members together. A tug boat 13 propels the vessel 15 and structure 12 to a selected location as shown in FIG. 2; the structure 12 is conveniently carried above the water, and offers no impedance to motion. In FIG. 3, the structure 12 is positioned above the selected location and preparations are made for founding the structure 12. The structure 12 is lowered with respect to the vessel 15 although this need not occur at every location.

Figure 4:
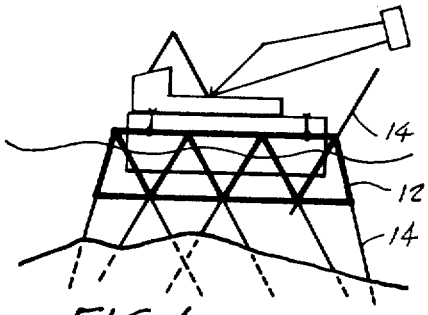
FIG. 4 illustrates the pilings driven through the structure and into the subsurface for support.
Figure 5:
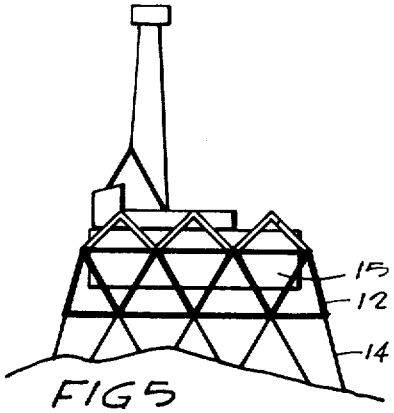
FIG. 5 illustrates the next step of fabricating additional structure thereabove.

In FIG. 4, the pilings 14 are driven into the subsoil and secured to the structure 12. When driven, the pilings constitute a continuation of the structure as shown in FIG. 4 moreover, the vertical extent of the pilings varies widely to accomodate a range of water depths. Attention is next directed to FIG. 5 of the drawings which illustrates erection of increments to the structure 12 to a higher level substantially above the water, although such increments might not be needed in every case.

Figure 6:
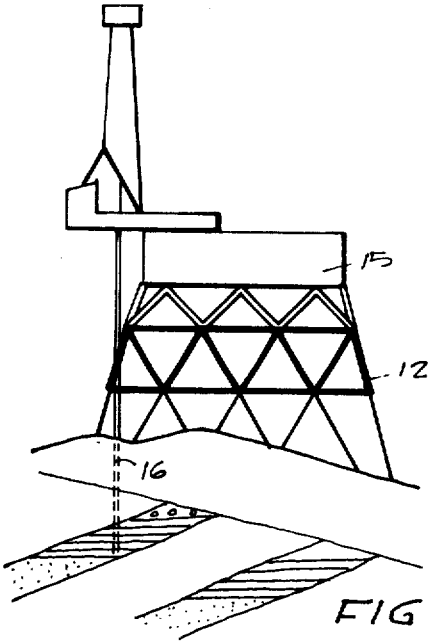
FIG. 6 shows the use of the structure of FIG. 5 to drill a well into a producing formation.

Attention is next directed to FIG. 6 of the drawings which illustrates the vessel 15 raised above the water even further to the optimum height of the structure 12. The means for raising the vessel 15 to the optimum height are numerous, varied and include, by and large, hoist works to lift the vessel 15 to the framework, and the like. The vessel is raised to the optimum level and the derrick of the drill works is erected and positioned to commence drilling. Note should be taken of the arrangement of paraphernalia on the vessel.

In the optimum arrangement, the vessel 15 is perhaps nonrectangular, preferably even circular. This arrangement results in several efficiencies. For instance, the circular arrangement of the vessel 15 is adapted to the structure 12 therebelow. During high seas, a wave has a linear front which strikes only two of the structural members at the water line at a time. That is to say, the impact of the wave front on the structure is spread over an interval of time. Another result of the circular arrangement of the vessel 15 is the ease with which the derrick is moved from one location on the platform to another drilling another well. For instance, in FIG. 6, a first well is drilled at the left-hand edge. The well 16 is cased and it extends to the producing formation. However, in FIG. 7, the drilling apparatus is shown on the opposite side of the structure. The move is easy on a circular and rotatable platform. Two means are at hand for providing rotatability. The cheaper, but possibly more cumbersome means is to provide for lowering the vessel 15 to its afloat condition, then rotating the vessel as a whole, then rehoisting it to its drilling position. The smoother method entails construction of a carrousel; this uses a lower section of vessel having an encircling rail for bearing the weight of the upper section, having the drilling apparatus in a most convenient relative relationship; the upper section is rotated as a whole on the lower section, permitting the most convenient relative relationship to be preserved.

In the prior art, a rectangular platform is usually used, and the equipment is shuffled about and disarranged, disconnected and connected, which is expensive, slow and even dangerous.

Wells must be reworked to optimize formation production. After drilling several from a platform it is difficult to go back to the oldest well and reopen it for a change in down hole gear. However the carrousel returns the derrick to previously drilled wells easily.

Figure 7:
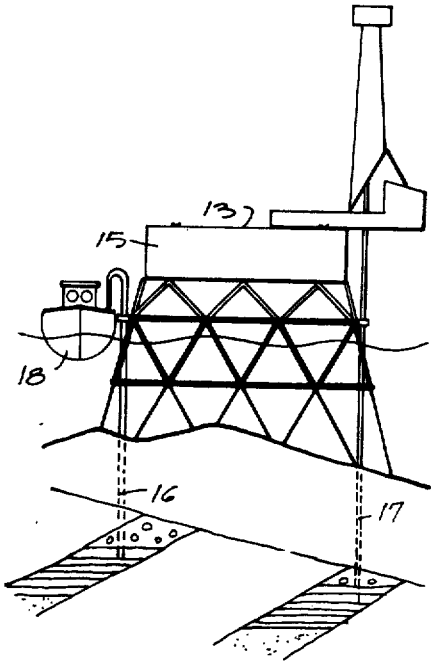

Consider, by way of example, the apparatus of FIG. 7 wherein a second well 17 produces. Quite often, the second well will have some effect on the first well, or later analysis of the first well will indicate workover of the first well. Customarily, a derrick is needed. This means, in the ordinary course of events that the drilling rig must be skidded across the deck and all the apparatus in the way is relocated. However, using the rotatable platform described above, it is possible to return the derrick to the desired position with a minimum of trouble and effort, and without disarranging production equipment which might have been installed in the lower section of the vessel 15 or on the periphery of the structure 12.

In FIG. 7, a vessel 18 is drawn alongside the platform for receiving the production from the first well. In the carrousel platform, this is conveniently possible simultaneously with drilling; it is seldom convenient in the prior art.

Figure 8:
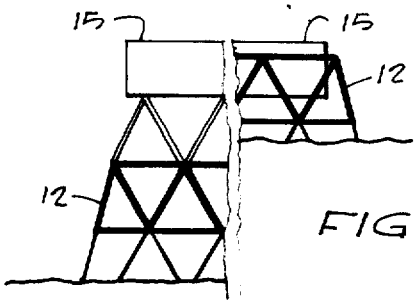
FIG. 8 is a view showing a wide range of water depths for which the method of the present invention is adapted.

Attention is next directed to FIG. 8 of the drawings which illustrates the wide range of water depths for which the structure 12 is adapted. Shallow water is indicated at the right and deeper water at the left.

Figure 9:
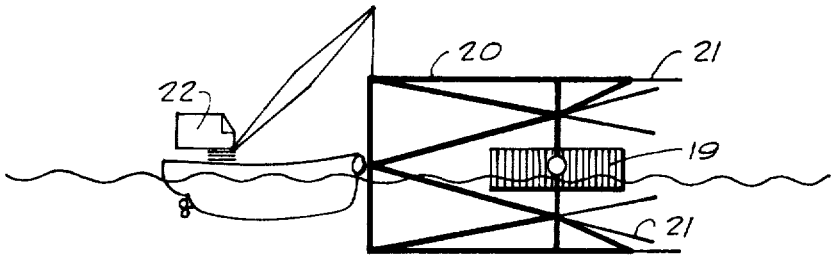
FIG. 9 is a view illustrating the method of the present invention for use in greater water depths.

In the drawings, an embodiment is shown in FIG. 9 which is similar to the embodiment shown beginning with FIG. 2. The floating vessel is indicated by the numeral 19 and is secured to a structure 20 having a plurality of pilings 21 carried therein. A self-propelled derrick barge 22 moves the combination through the water. The buoyance of the vessel 19 tends to lift the forward portions of the structure 20 and the barge 22 lifts the rear of the structure 20 horizontally and not vertically is that the embodiment shown in FIG. 9 is launched in shallow water for use in substantially deeper waters. A wide range of water depths is accommodated by the structures of FIGS. 2 and 8; a deeper range is accommodated by the structure 20.

Figure 10:
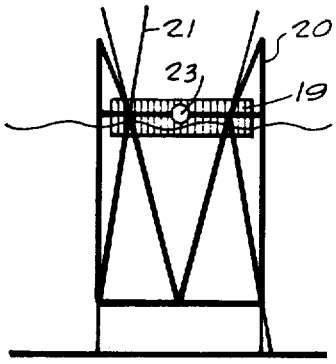
FIG. 10 is a view similar to FIG. 9 showing the structure properly oriented in deeper water.
Figure 11:
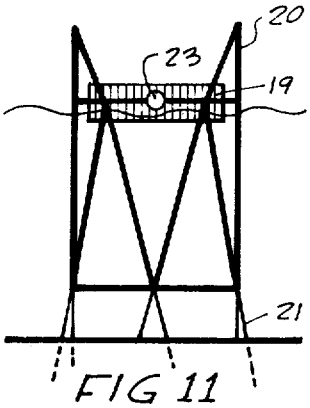
FIG. 11 is a view similar to FIG. 10 wherein the pilings carried in the structure are driven into the subsoil.

The vessel 19 is normally secured to the structure 20 by shock absorbing means to secure the vessel to the structure for safety and protection. In FIG. 10 the structure 20 has been released by the derrick vessel 22 and hangs downwardly toward the submerged land. Thereafter, the various pilings 21 are driven into the subsoil to support the structure. This is shown in FIG. 11. Also, it will be noted that the releasably securing means 23 is kept connected until the structure is founded. Until the structure is founded, it tends to wash to and fro and to bump and jolt against the vessel and cause damage. This problem is prevented by the use of appropriate releasable securing means at two or three points about the vessel. Energy absorbing devices including those operative by hysteresis, possibly of compression and expansion of metal is one alternative means.

Figure 12:
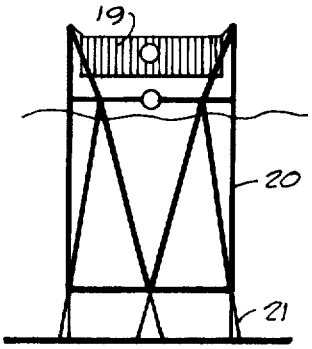
FIG. 12 shows the method of the present invention as further elevating the vessel whereby the vessel is more free of wave action.

Attention is next directed to FIG. 12 which shows the vessel 19 elevated above the water line free of the wave action. The structure carries the vessel 19 at a height of perhaps 50 to 60 feet above the water line. The entirety of the weight of the vessel is then received on the structure which is properly founded and footed with the pilings 14 engaged in the subsoil.

Figure 13:
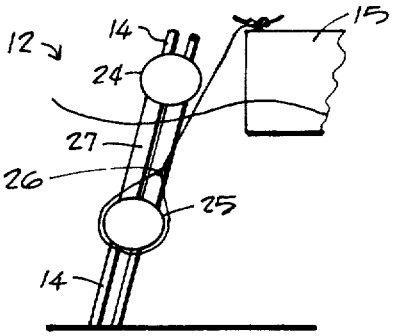
FIG. 13 illustrates details of a major structural member of the structure shown in FIG. 3.

Attention is next directed to FIG. 13 of the drawings which is a detailed view of a water-exposed portion of the structure of the vessel (see FIG. 4). The vessel is represented at least partly at 15 and is secured to the framework as follows. Preferably, a pair of piles 14 form a support of the structure 12. The view of FIG. 13 shows a pair of generally similar elliptic tubular members 24 and 25 having an elliptical cross section. Some efficiency is obtained in terms of metal weight by use of elliptical members. This is particularly true at, above, and below the water line since the force of the wave on a structural member depends on the broadness and streamlining of the structural member. The elliptical arrangement is adapted for use in the present invention. A line 26 is tethered to the vessel 15 to at least partly secure the framework to the vessel. The member 25 is tied to the vessel and released when positioned.

Figure 14:
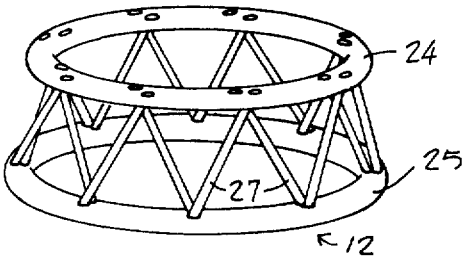
FIG. 14 is a perspective view of the framing of a platform adapted for use with the present invention.

Attention is next directed to FIG. 14 of the drawings which illustrates in perspective the load bearing members of the structure 12 and possibly part of the structure 20. The structure includes preferably an upper ringlike member 25. A plurality of evenly-spaced, angled members 27 and 27, which correspond to the downward, clockwise and counter clockwise ruling on a hyperboloid, are braced between the two ringlike members to form a frame. Each bracing is connected into a bracket to form a bipod. The bipods are spaced about the structure uniformly to brace the frame. In further particular, the vertical height is increased by stacking the ringlike members 24 and 25 with the bipods between levels.

Figure 15:
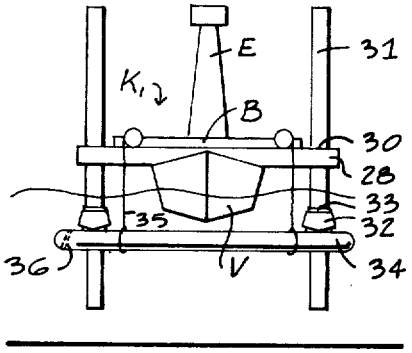
FIGS. 15–21 illustrate a further modification of the modular system concept in which a ring-like structure is utilized for supporting a jackup rig in medium depth water when a large number of wells are required for production.

With regard to the sequence of FIG. 15–21 the vessel V has spacing-jack-and-coupling-means $G_9$ comprising jack-holders 28 secured to the vessel V by means 29 and leg wells 30 at the end of the said jackholders 28 whereby the vessel may be supported on four legs 21 arranged in a rectangle about the vessel. In FIG. 15 there are pontoon-like footing members 32 having sleeves 33 therethrough. The modules 32 lie parallel across a ring-like module 34 which is the particular station module to be mainly considered here in the sequence of FIGS. 15–20. The modules 32 of course may serve as station modules in other sequences of steps. The connector $K_1$ comprises a cable going to a winch mounted on the jack-holder 28. The winch upon which the cable 35 is wound serves to lift up and hold up the module 34 when that is necessary in transit. The cable 35 is wrapped around the module 34. There are four (4) such cables 35 disposed in a rectangle whose corners are the four points on the module 34. The connector 33 comprises a sleeve passing fully through the module 34. The leg wells 30 in the end of the member 28 lie fully clear of the water therefore allowing the legs 31 to pass, in clear sight of an observer, through the leg wells 30 and through the connector sleeves 33. In FIG. 15 the connector sleeve 33 is welded to the means 31 so that there is a structure comprising 31 and 32 together. There are two structures comprising 31 and 32 together and each of the structures is thus an H-shaped frame. In a convenient and efficient manner there is a rig E disposed on a base B which lies athwart the decks of the vessel V. The sequence of drawings reveals the advantage that a convenient and efficient disposition need not be disturbed even while drilling a large number of wells with apparatus of the figure.

Figure 16:
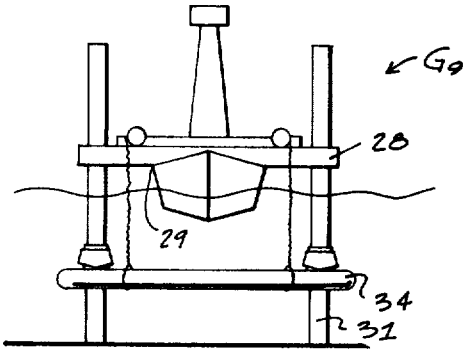
Figure 17:
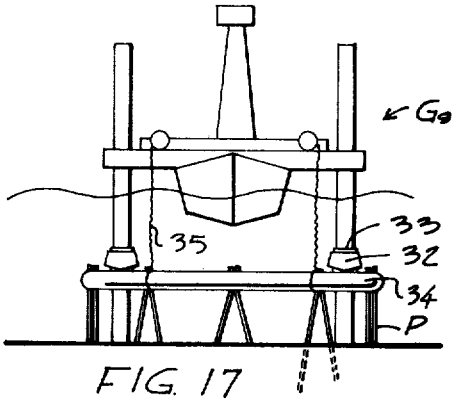
Figure 18:
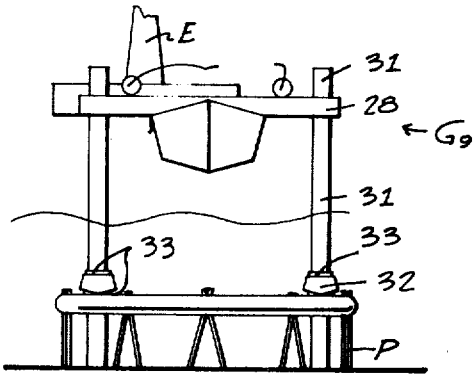
Figure 19:
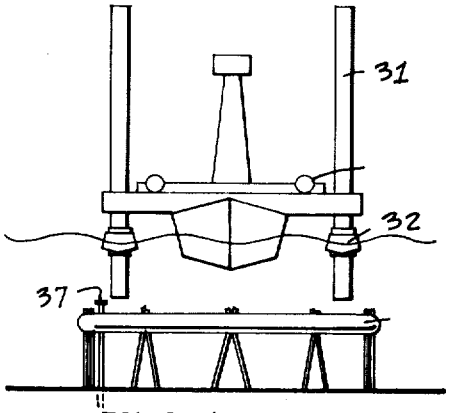
Figure 20:
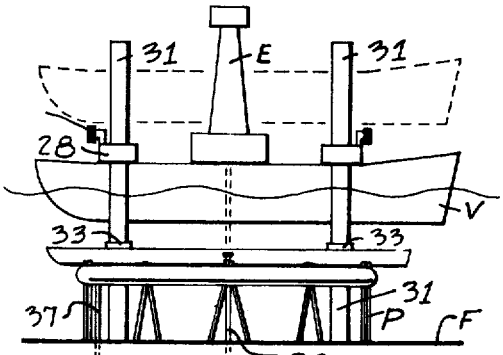

In FIG. 15 the vessel V is in transit having a ring-like module 34 carried therebeneath with the weight thereof supported by the connectors 35. In FIG. 16 the vessel has arrived at the station site and the apparatus $G_9$ comprising 28, 29, 30, 33 and 35 together have cooperated to lower the structures comprising 32 and 31 along with the module 34 to the marine floor in a position for stationing. It will be observed that the legs 31 contact the marine floor although they will not be called upon here to support the entire weight of the vessel. It is envisioned that in most situations it would be possible for them to do so. Situations where this might not be possible include circumstances in which the marine floor is a very soft mud. Even in such a case, however, the legs 31 embedded in the soft mud would prevent lateral motion of the ship permitting steps similar to those pictured to be completed. Returning to the sequence which is pictured the legs 31 have engaged the marine floor and the module 34 is now in a position to be founded and made stationary with respect thereto. In FIG. 17 piles are shown to have been inserted through the pile receiving means 36 in the module 34. The piles have been inserted in pairs, each pair forming a bipod, so that a series of bipods is disposed equally around the module 34. A preferred geometric array for such piles P would be as rulings on a hyperboloid of revolution of one sheet. This is not necessary but only a preferred arrangement and the arrangement which is pictured in FIG. 17. In FIG. 18 the vessel has been raised by the apparatus $G_9$ to an elevation clear of the waves. Depending on conditions, the weight of the vessel will be borne partly through the legs 31 and partly through the piles P. The marine floor, depending on its particular character, will support most of the weight through one or the other of the sources or it might support the weight equally between the legs 31 engaged in the marine floor and the piles P which are driven into the marine floor. In any case, the vessel is stably supported clear of the action of the waves and in such a condition as to allow drilling operations to begin. It will be observed that in the arrangement pictured in FIG. 17 and that pictured in FIG. 18 the means 35 has been released from the ring 34 so that it no longer resides in the water. The winches coupled to the cables 35 are now available for further work such as hoisting apparatus onto the decks of the vessel V, if it be desired to do so. It will be appreciated that the means 35 could be replaced by mobile cranes. The simpler arrangement shown in the drawings is shown only for illustrative purposes. Rotary cranes such as are commonly found on offshore rigs would fulfill this function very well. In FIG. 18 the vessel V has been elevated by apparatus $G_9$ and the rig E has been moved on its base B to a position far outboard the vessel. This is the position most convenient for drilling, around the periphery of the ring, advantages of which will appear and will be explained. In FIG. 19 the well that the rig drilled from the position shown in FIG. 18 has been completed. The well is marked 37 in FIG. 19. In FIG. 19 the modules 32 have been withdrawn from their position atop the ring 34. They have been withdrawn by action of the apparatus $G_9$ operating in the same manner as has been pictured and shown before in this specification. The rig E has been returned to its position in the center of the vessel. The vessel y is now free to float and leave the site if it should be desired to have it leave the site. However, that is not what is pictured as will be seen in FIG. 20. In FIG. 20 the rig is shown after the drilling of another well 38. FIG. 20 is a side view of a position similar to the position of FIG. 16. The steps that have transpired between the situation pictured in FIG. 19 and that pictured in FIG. 20 are as follows: vessel V vessel was revolved through 90° from its picture in FIG. 19. The modules 32 were returned to contact with the ring 34. The vessel V was elevated by apparatus $G_9$ above the action of the waves again. The rig was moved outboard to a position similar to the position of FIG. 18. The well 38 was drilled from that position and the well was completed, then the vessel V was returned to the waves as pictured in FIG. 20. The vessel is free to leave or to drill other wells in a similar manner as might be desired. The considerable advantages obtained from the sequence that is illustrated will now be explained. Of first advantage is that the ring-like structure is quite strong and is well adpated to uses requiring structural strength. For example, the ring-like structure is well adapted to receive a spherical vessel as will be explained and described in FIG. 27 later. An important advantage relates to the efficient disposition of the rig E and its associated apparatus on the deck of the vessel V. Only one arrangement is best from the standpoint of working. A vessel has limited decks and limited space and a limited amount of apparatus and there is one most efficient disposition of the apparatus on the deck of any vessel. In the prior art either the vessel must be moved with respect to the well, which is actually the situation that is described here, although the advantages that are shown here do not accrue to the prior art; or else the rig must be skidded around on the deck of the vessel thereby disturbing the most efficient arrangement requiring additionally skids on the deck which interfere with the arrangement. In the case shown, a very large number of wells could be drilled without disarranging the deck of the vessel. The vessel is simply revolved and placed in a different orientation on the rign 34. For example, the wells 37 and 38 are at 90° to one another in the figures being discussed. However, other wells could certainly be drilled at 5° intervals if it were so desired yielding say 72 wells around the ring 34. In the prior art no such convenience is obtained. Other advantages of having the wells in a ring-like array about the well supporting structure are as follows: If production apparatus be placed at each one of the wells, then the production apparatus will interfere with the rigs being placed around to work over the well if one should become stopped up, where with the arrangement shown, a workover rig can approach the ring from the side and not disturb production apparatus which might be placed in the center of the ring-like structure. Another advantage is that if it is necessary to stabilize a vessel while driving piles through the sleeves 33, the modules 32 provide a means for so stabilizing the vessel. It may be noticed that the legs 31 are engaged in the marine floor. However, after the ring is once founded, if it were desired to extend the reach of the legs so that the vessel might be raised to a higher position than that shown in FIG. 18, it would be possible to release the connectors 33 from the legs 31 so that the legs 31 could be withdrawn and so that only their tips would reach the means 33, therefore the vessel V would be placeable at a higher elevation than that shown in FIG. 18. Various conditions might warrant this. For example, it might be desirable to use a rig in waters deeper than the waters illustrated, or it might be desirable to raise the vessel to a higher position in anticipation of a severe storm. An advantage accruing to all the apparatus is that the vessel can be quickly removed in case of a storm, leaving the wells supported by the ring-like module 34. One of the greastest advantages of the present invention is that operation advantageous to the conditions at hand can be obtained without the loss of the ability to operate under other conditions. Another important advantage of all the apparatus illustrated is that the legs 31 might be removed entirely from the vessel thereby allowing the vessel to pass through constricted places such as the Panama Canal. Other advantages discussed elsewhere will, of course, also apply to the FIG. 15–20.

Figure 21:
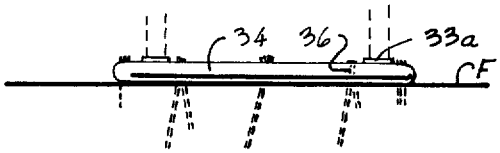

FIG. 21 is used to illustrate that the ring-like module 34 may lie on the marine floor, thus evidencing the fact that it need not have been placed above the level of the mud, thereby doing away with the necessity for having a means 36 being a sleeve through a module 32. FIG. 21 also illustrates that the connector for the legs 31 might be a simple socket disposed atop the ring 34. The socket is marked 33a in FIG. 21.

Figure 22:
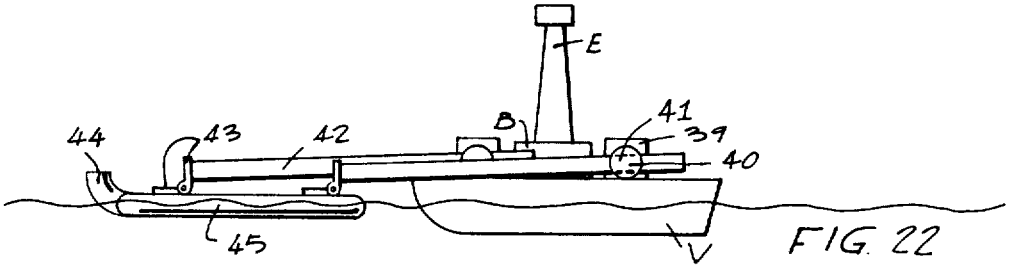
FIGS. 22–27 illustrate a modification to the structure of FIGS. 15–21 for use in relatively deep water, this being accomplished by the rotatable leg means.
Figure 23:
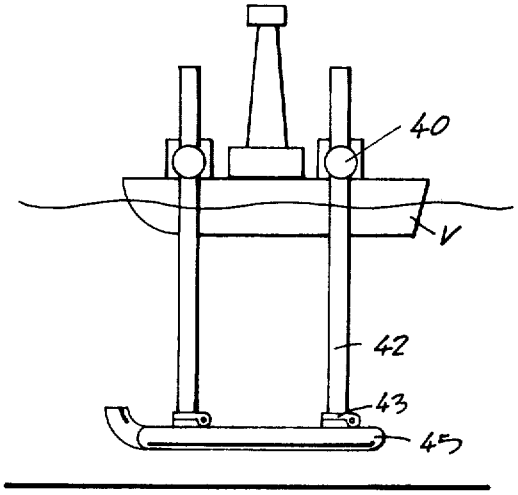
Figure 24:
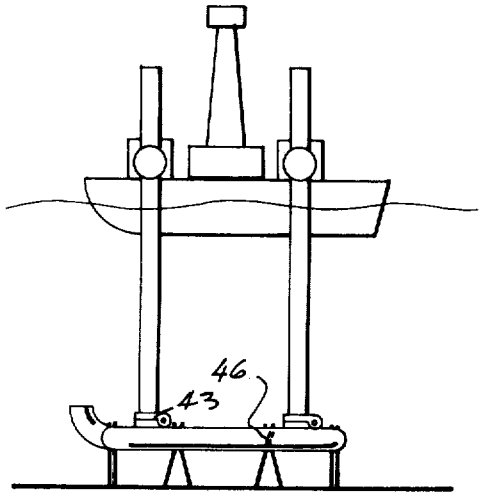
Figure 25:
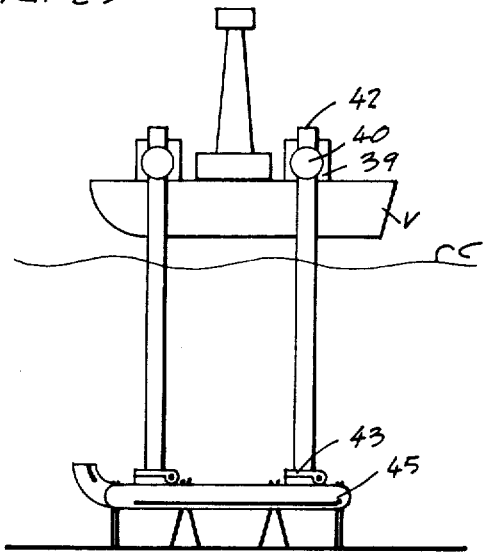
Figure 27:
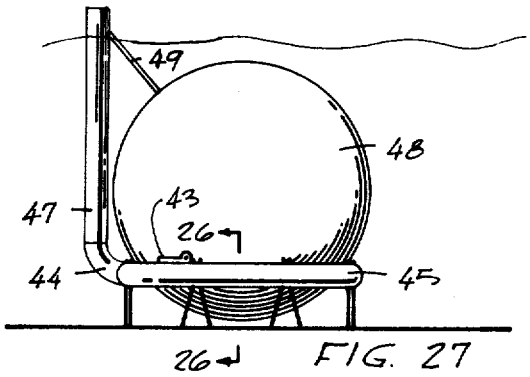
Figure 26:
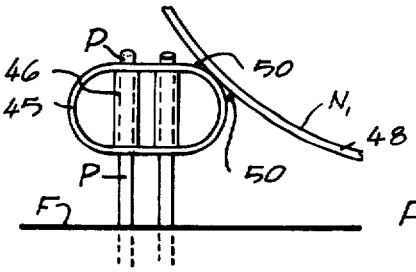

The sequence of FIGS. 22–25, and then later extending to FIGS. 26 and 27 expands the advantages of previous figures to include their operation in deeper waters and to exploration at sites far from the shore. The apparatus of FIG. 15 presents a considerable impediment to passage through the water in contrast to the apparatus of FIG. 22. The apparatus of FIG. 22 therefore has advantages. In the latter case the rig can pass through shallow water without having a large structure far overhead causing the vessel to be unstable. In FIG. 22 there is a vessel V having pillow blocks 39. Other pivotal bearing means might be employed, or other connectors allowing rotation. There is also a pivot means 40 which likewise might have a different character from that illustrated. In any case, there are leg wells 41 in the ends of the means 40, and the leg wells 41 may be rotated through means 40, therefore allowing rotation of means 42. The means 42 are legs. At their bottoms their is a hinge 43, which is releasable. It need not be however. Advantages with respect to a stable foundation preventing overturning of the jackup rig illustrated in the figure would still be obtained. Conversion of the ring 45 to a production structure would not be obtained without releasability of the means 43, however. Releasability is obtained optionally by removing the hinge pin by any number of means as by diving or as by using an explosive connector in the hinge pin which would release the leg 42 from the ring 45. There is a ring 45 which is similar to the ring 34 of the just preceding figures. On the vessel V there is base B with exploration apparatus E, a rig similar to the rigs in the preceding figures. The front jackholder 40 will be observed as somewhat longer than the rear jackholder 40. It will be appreciated that the rear jackholder 40 might house only a single leg rather than the two legs illustrated, thereby making a three-legged jackup. However, fours legs are illustrated. Each leg pictured conceals another parallel leg which is directly behind it as the view is taken. The front jackholder 40 is longer so that the front legs may pass the rear legs as illustrated. The sequence of operations may now be described. In FIG. 22 the vessel V travels through the waters towing the module 45 behind it. The means 39 and the means 43 have been released with respect to rotation so that the module 45 may freely move in an arc with respect to the axis of the means 40, thus oscillating in the means 39 so that the module 45 may bob up and down in the water behind the vessel. This is, of course, not a necessary arrangement. The module 45 might very well be supported clear of the water by locking the means 39. In FIG. 23 the module 45 has been driven into the water. Two means are available to do this and the means envisioned consists of powering the legs downward, possibly by attaching crane lines to the legs 42. In any event, those skilled in the art will be well able to provide means to urge the module 45 into the water. Another means is available, however, which is the ballasting of the module 45. If the module 45 were ballasted by introducing water into it, then it would sink and draw the legs 42 along with it, to the position shown in FIG. 23. In either case, the position of FIG. 23 can be obtained. In FIG. 23 the vessel floats on the waves and tensile forces in the legs 42 support the module 45 if the module ballasted. However, as shown, it will be compressive forces in the legs 42 because the module 45 is pictured as being not ballasted but as being empty of water, therefore containing air and certain requisite apparatus. In FIG. 24 the module 45 has been founded by driving piles P through the means 46 in the module 45, similar to the means pictured for the module 34 of FIG. 17. In FIG. 25 the vessel has been elevated above the water just as the vessel was elevated above the water in FIG. 18. FIG. 18 is, of course, a front view and FIG. 25 is the side view. The two views are directly comparable, however, and it will be observed that the hinge means 43 of FIGS. 22–25 do away with the necessity for the winches illustrated in FIGS. 15–20. The sequence is similar to the sequence of FIGS. 15–20 which could be exercised by the apparatus of these FIGS. 22–25 provided other means K than those shown were installed; for example, numerous extra leaves could be provided on the ring 45 with extra hinge pins allowing the vessel V to be positioned in a variety of positions around there. This might be desirable in some situations; however, that is not the situation pictured. Instead there is shown one leaf of the hinge 43 permanently attached to the ring 45 and the means 43 is releasable by removal of the hinge pin. In the situation illustrated, the vessel could be revolved through an angle of 180°, the legs 42 could be rotated to 180° in their housings 41, and the position of the vessel could be reversed. Without extra leaves for means 43, no other positions could be readily obtained.

The sequence of FIGS. 22–25 is directly comparable to the sequence of FIGS. 15'20. Now, FIG. 26 illustrates details which might be common to the operation of both sequences of FIGS. 15–20 and 22–26. FIG. 26 is a section taken through the ring 45 of FIGS. 22–25. The ring 34 might be likewise similarly represented. The arc $N_1$ represents a possible position for a curved (spherical) or other vessel, as shown in FIG. 27. Here there is illustrated (FIG. 27) a completed installation having the elbow 44 unchanged except that a column 47 having elevator or stair means therein reaches above the surface of the waves. There is a spherical vessel 48 used for production purposes and for storage purposes and a brace 49 which supports and braces the elevator means 47 to the spherical vessel 48. The means 47 allows personnel to descend through the elbow 44 to open a door in it, if a door be provided and to enter the ring 45 thereby allowing access to the pile sleeves 46 for inspection of the connections to the piles P and also thereby allowing the completion of connections 50 illustrated in FIG. 26 which will now be explained. The connectors 50 are ring-like gaskets of a diameter of the ring 45 therefore extending all around the sphere 48. Therefore, when a person enters the ring 45 through the access means 44, he will be able to cut with a torch through the part of the ring 45 which is directly between the connectors 50. The connectors 50 will seal out water and make it not possible for it to enter the ring 45 and drown the man working therein. Then the man working therein will be able to make a weld of the ring 45 to the spherical vessel 48 so that the spherical vessel will not float away when it is de-ballasted. Thus the spherical vessel will contain petroleum and the ring 45 may contain apparatus. It will, of course, be appreciated that other vessels than 48 could be provided having a great deal of prefabricated and pre-arranged and pre-installed apparatus therein so that when the vessel 48 is delivered and deposited on the ring or station module 45, it can be positioned by simple welding to the ring 45. All of the space within the spherical vessel 48 could be available for housing apparatus and equipment. Also, the ring 45 is well adapted to receive the hyperboloidal shell disclosed herein. However, the situation pictured is that the vessel 48 is provided to house only fluids such as petroleum. The ring 45 is, of course, available for production purposes and pumps and other apparatus might be located therein along with work spaces for men.

The ring-like structure of FIGS. 22–27 is, of course, rudimentary and it will be clearly understood an appreciated that the ring-like structure 45 might be of any degree of complexity, being itself a large complicated ring with many work chambers therein, airlocks and pre-installed and prefabricated apparatus planned for any variety of work; for example, Christmas trees; pumps, compressors, connectors and crews quarters could be housed in such a complex ring-like structure. It should be clearly understood that all of the figures have this schematic character and are designed to illustrate the rudimentary form of the invention.

Now the FIGS 28–31 will serve to illustrate certain structural principles that are common to the various embodiments of the invention. An essential aspect here is noted. In the prior art, mobile rigs are built as a unitary whole. They are not built with a view to modularity and they are not built with a view to the changing of the structures which support the weight of the vessels. This is different from the siutation pictured herein before and made possible by the present invention. Consider the situation obtained, for example, in a mat-type jackup of the prior art. The mat-type jackup is made with legs which are not intended to be removable and with a mat which is intended to cooperate permanently with a vessel. It will be seen that if the jackholders or the legs wells or the spud wells, or whatever they might be analogously called in the prior art, receive the legs at their upper ends; if they restrain the legs and tend to hold them in a vertical position through the structural stiffness and strength of the barge body; and if the mat does the same at the bottom, then the situation following will be obtained: The bending moment at the bottom of the legs will be similar to the bending moment at the top of the legs; another way of saying the same thing is that if the legs be constant in their cross section, the radius of curvature will be similar at the top to what it will be at the bottom. Therefore, the structural strength of the legs at their tops and at their bottoms will have been determined during the design of the vessel. The vessel will not be available nor operable for uses in other depths than those for which it was designed.

In the situation with tensile cable legs having no bending strength, the following situations occur: The vessel may be designed independently of its supporting station module, which may be designed to suit conditions of use, so that the advantages of the present invention are still obtained.

Figure 28:
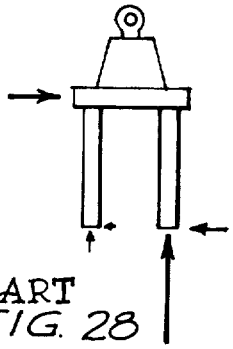
PRIOR ART FIG. 28
FIG. 28–31 illustrate certain structural principles of the present invention.
Figure 29:
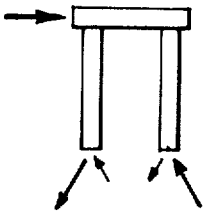
Figure 30:
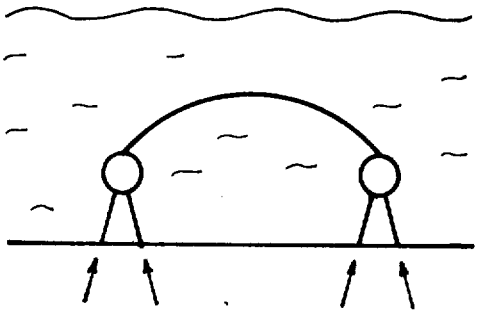
Figure 31:
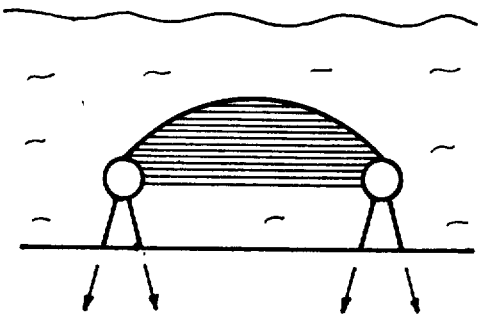

FIG. 28 pictures the situation of the prior art where a mobile rig which is bottom supported must be sufficiently heavy that the lateral forces which form a couple, those due to the waves and those due to the mud, which tend to overturn the mobile rig are overcome by the weight of the mobile rig. The moment of restitution of the mobile rig must exceed the overturning moment or the mobile rig will be overturned. Therefore, although much advantage in cost and mobility could be obtained by making mobile rigs lighter than they are presently made, it cannot be done because they would be overturned by the waves. The situation obtained in the present invention is illustrated in FIG. 29, which is schematic representation of the structural action of such apparatus as in FIG. 7, for example. The piles imbedded in the mud exert both tensile and compression forces, therefore the mobile rig may be lighter, for the moment of restitution resulting from the weight of the rig is not the only righting moment available; righting moment is obtained by the tensile strength in the piles driven into the mud thus a mobile rig may be made lighter and therefore more mobile and more economical by the employment of the piles of the present invention. The mobile rig has departed, in the situation pictured in FIG. 30 which is a structural schematic view that might be compared to the sequence of FIG. 15 or the apparatus of FIG. 27. In particular, this is schematic and more applicable to FIG. 1. When no bouyant fluid is contained within the station module, the piles tend to support the weight of the station module in compression. When a buoyant fluid is in the station module, the piles tend to support it in tension. Therefore it can be seen that not only do the piles in their divergent pattern tend to support the rig against lateral forces when the rig is present but they also tend to support the station module in a superior manner after the rig has departed.

Figure 32:
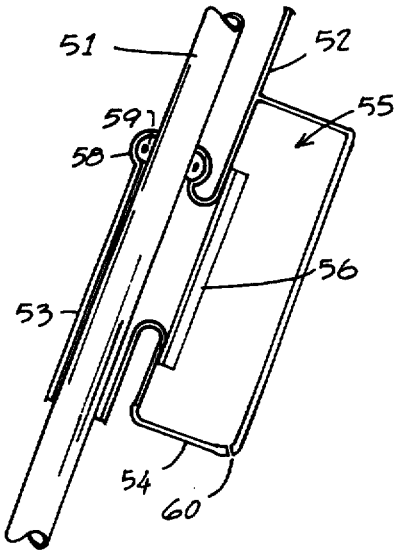
FIG. 32 is a section of one means for securing a piling to a hyperboloidal shell.
Figure 33:
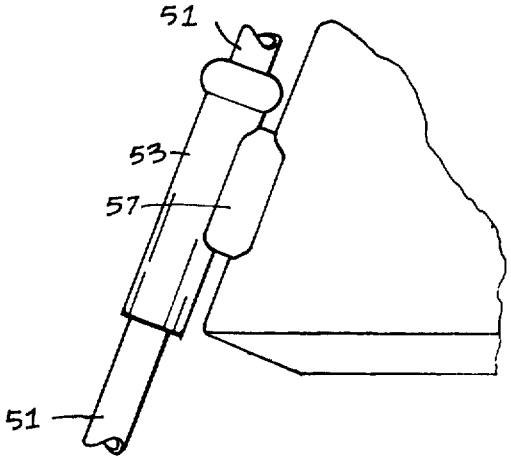
FIG. 33 is an elevation of the device of FIG. 32.

Attention is next directed to FIGS. 32 and 33 of the drawings which are a sectional view and an elevational view of means for connecting the piling to a shell structure 52. A surrounding jacket 53 extends fully about the piling 51. The lower end of the structure is indicated by the numeral 54. The passage 55 opens through doors 56 into the jacket surrounding the pilings and at the nacelles 57 for working access. The jacket 53 has a bead 58 about its upper perimeter and a hose or other conduit 59 is placed within the bead of the jacket. The hose communicates fully about the circumference of the piling 51 an also with the structure 52. Using available techniques, the hose 59 is inflated to seal against leakage.

Air under pressure and forced down the structure 52 forces water into the chamber 55 and out through a chamber vent 60. Once the leg chamber 55 is freed of water, a workman is given access to the leg chamber. By the use of sealed opening from the chamber to the nacelles formed in the jacket 53, the workman has access to the individual pilings. Piling 51 is then fixed to the nacelle 57 by means such as a stop collar, welding and the like. On completion, inspection is permitted. Thereafter, the workman may leave the chamber and perhaps the temporary seal in the bead may even be released.

Figure 34:
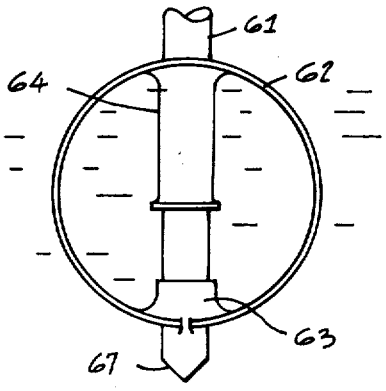
FIGS. 34–37 is a sequential series of views illustrating one method for connecting pilings through a footing member.

Reference is next made to numerous past views wherein a substantially tubular footing member or pile cap is shown. For instance, a footing member 34 shown in FIG. 15 have several pilings connected; a similar set of members is found in the sequences beginning with FIG. 22. If the platform above the structure is, say, 100 feet or more long, the cylindrical footing member may also range up to 100 feet through. With this in view, attention is directed to FIG. 34 illustrating in sectional view a portion of the tubular footing member which receives the pilings members through guide means to be noted. In FIG. 34, a piling 61 having a lower end 67 is urged through the footing member 62. A lower guide 63 and an upper guide 64 direct, align and position the piling 61. The piling is inserted through the guide means before the connection is made between the piling and the footing member.

Figure 35:
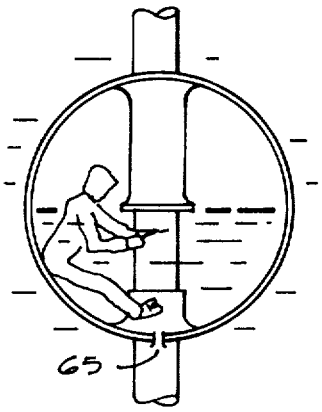
Figure 36:
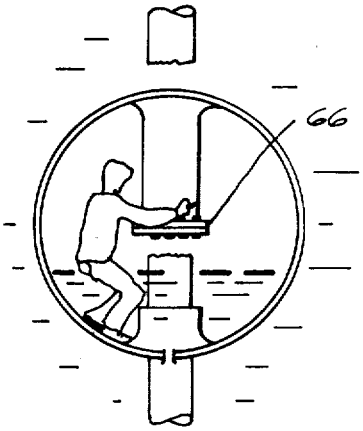
Figure 37:
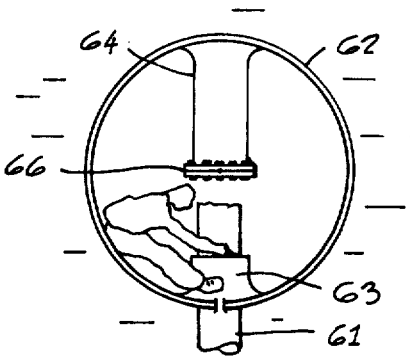

To fasten a piling to the pile cap, the chamber within the footing member 62 is partially purged of water as shown in FIG. 35. Air is forced into the chamber and both a lower opening 65 and the annular crevice around the pile provide escape for part of the water. The chamber is partially purged to permit entrance of a workman gaining access to the exposed piling 61. The workman enters the chamber and may utilize appropriate means to cut the piling 61. If the piling has excess length, the upper unneeded portion, when cut free above the guide means 63, is removed as shown in FIG. 36. This then permits the workman to attach a cover plate 66 to the upper guide means 64 to seal off the chamber from water entering through the upper guide means 64. Alternatively, other means could be used to seal off the communication to the outside through the upper guide means, perhaps without need to remove the upper part of the piling, sealing the guide means 64, this leaves the chamber air tight at least above and permits the complete purging of water from the chamber. This then permits the workman better access to the lower guide means 63 and the piling 61. The workman is then enabled to place any desired sealant, if sealant is desired between the piling 61 and the inner wall of the guide means 63 to caulk off the chamber. The connection between piling and footing may then be perfected as needed. In FIG. 37 the man is shown making such connection.

Attention is directed to the value of the present invention in counteracting harm from the scouring action of the water beneath the feet of the jackup legs. Erosion beneath a footing member is a real problem and has caused numerous rig failures, especially in the North Sea. In the North Sea, the continual water movement scours the soil, and bearing members seem to accelerate the erosion. When the soil is washed out and the support is destroyed, a structural tragedy occurs without advanced warning. However, in the present invention, the effects of scouriing action are defeated by the use of divergent pilings. Moreover, the soil about the footing members may wash away without affecting the support of the pilings themselves. This is of critical import in certain environmental circumstances.

In views 38-40, a new structure and somewhat modified vessel and means of operation will be discussed.

Figure 38:
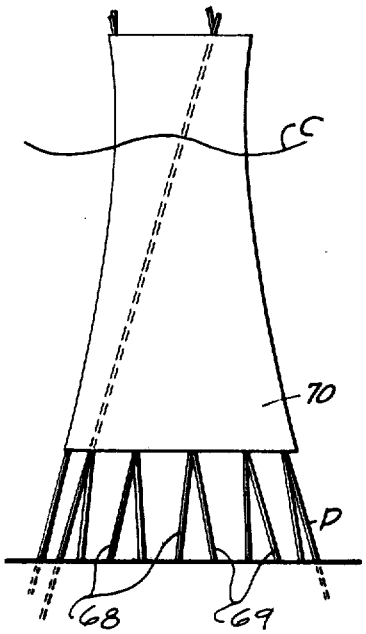
FIGS. 38–40 illustrate a modified structural station module for resistance to heavy lateral loading and which is adapted for obtaining lateral stability in uncertain, variable depths.

As introduction to the modified vessel structure and method of operation, brief attention is directed to the drawing of FIG. 38 wherein there is shown a fixed platform of a type not generally known in the art. FIG. 38 is of a rudimentary elongate structure 70 supported by a plurality of pairs of downwardly divergent piles 68 and 69 which most closely approach to one another proximate the water line C. This is done because the center of effort of lateral forces from wave action is at the water line and in order to reduce the resultant effect of those lateral forces the obstructing surface of a supported structure is designed with minimal area thereat. Thus FIG. 38, through illustrating a generalized and simplified form of structure intended only to describe the above principle, demonstrates a most advanced and effective platform or other structural support and whose strong relevance to the present invention will become apparent hereafter. Briefly it is pointed out, however, that the structure of FIG. 8 may consist of a hyperboloid of revolution of one sheet and which is characterized by its ability to spoil the oscillatory effects of waves, sometimes known as the Von-Karmann effects, and with the further quality, as briefly noted above, of presenting the least area of resistance in the zone of most lateral force. Rather than three pair of divergent piles, the structure may comprise families 68 and 69 of divergent piles, each family of which is disposed as rulings on a hyperboloid of revolution of one sheet, one (68) ruled with clockwise downward progression, the other (69) being ruled with downward counter clockwise progression. The two families form a generalized bipod when conjoined by the shell, and as a result one family resists shear on one face by tension, the other by compression. On the opposite face the role is reversed. The resultant structure is ideal and novel because of its capacity for containment of oil, especially spills, and also for its simplicity, high strength-to-weight ratio and also for employment of the structure as the module 70 in the figures as now discussed.

Figure 39:
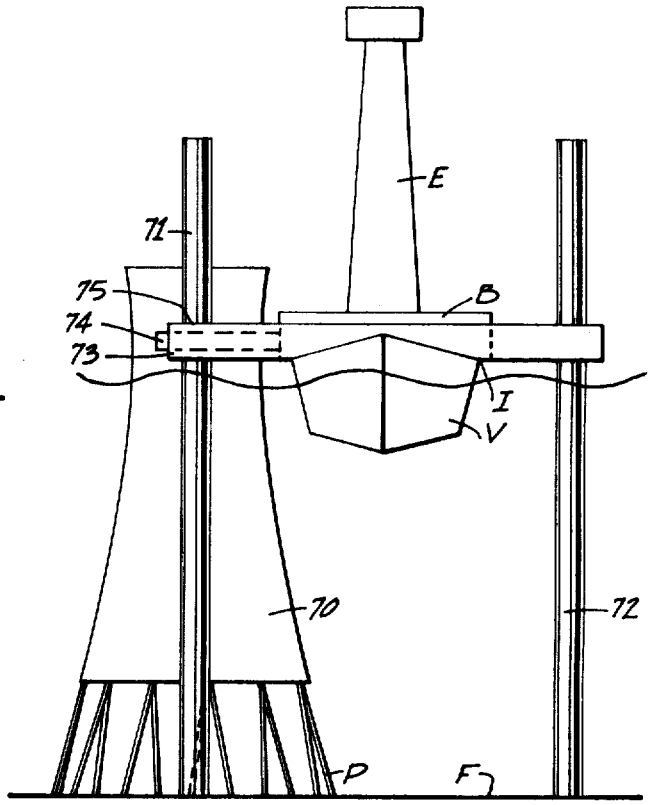
Figure 40:
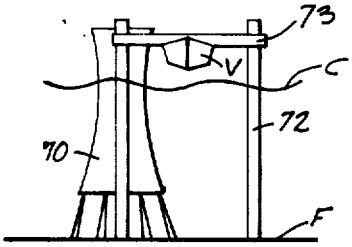

In FIG. 39 the fixed platform of FIG. 38 is used as a statin module 70 and is shown in operational relationship with the vessel V which has jackholder 75 supported at one side by module 70 and at the other by jacking module (leg) 71. An exploration apparatus E is supported on a movable skid or base B on the deck of the vessel. The module 70 in each figure disposed between the two holders, the module stops short of the bottom and is supported by piles P extending from it through the water into the marine floor, and 3) the connector aid in the support of the vessel V. As may be seen in the view of FIG. 40, the module 70 resides between the jacking modules 35 on one side of the vessel V. The legs 71 and 72 generally tend to buckle laterally, but as FIG. 40 illustrates, the buckling will be resisted by the great lateral strength of module 70 transmitted through couplings 74, thereby allowing operation in deeper waters.

An important part of the teachings herein concern hyperboloidal structures. The module 70 just disclosed is a simple such structure; since others follow, this is a good point to review the singular and previously untaught character, features, and advantages of such structures in the offshore. Included are hyperboloidal shells, frames, and pile arrays, being aspects of structure; in point of view of function, are included mobile rigs, moored structures, and fixed platforms as well as novel structures such as separable-leg jackups taught in U.S. Pat. Nos. 3,575,005 and 3,716,993. All of the foregoing are hyperboloidal structures. The simplest expression of the hyperboloidal structure is the shell which for brevity shall be used in the following discussion.

The hyperboloidal shell is a ruled surface, that is, straight lines can be drawn on it. That fact alone is a weighty factor in its favor, for it is therefore compatible with straight tools and straight supports and can be formed by employing straight components (such as reinforcing bars and taut prestressed strands, in the case of concrete structures). Its geometry is therefore easily described for use in computer programs, and many programs are available for structural analysis of such shells.

The shell can be optimally located in the water, due to the fortuitous combination of a wide base, a wide top, and a narrow waist. The base is advantageously wide for stability and for contained volume (as for storage uses); water forces are low near the bottom, so width is no great handicap. The top is advantageously wide for support of working apparatus above the waves. The waist is advantageously narrow for economy of material and for diminished vulnerability to the hosile environment of the water surface. It is there at the surface that corrosive and erosive effects are greatest, and that the force of such impact is likely to be greatest.

The shell is doubly curved, to great advantage. Its curvature in each and every plane is greatest near the water line (when optimally located, of course). It is there that greatest strength is needed, and it is there, at points of greatest curvature, that doubly curved shells are strongest. The double curvature tends to defeat oscillation and deflection.

The shell is well adapted to concrete construction, and concrete especially in the form of ferro-cemiento, which is strong, lightweight, resistant to deterioraton, and repairable in a marine environment.

The shell is smooth, and presents the same aspect in every direction. It is therefore ideal in icy waters or stormy waters; it will deflect the forces of nature; it will be unlikely to accumulate ice, debris, or organisms.

All of the above features and advantages apply to fixed or floating shells, but, in floating structures, the shell has astonishing advantages over the prior art.

Consider the hyperboloidal shell used as the hull of a semi-submersible when compared to the multi-column semi-submersibles of the prior art. The multiple columns of the prior art must be joined by structure. The joints of such structure are notorious for problems of analysis, of design, construction, reliability, and repair. Such prior art structure impedes the passage of waves, corrodes and is costly. No such structure of the prior art could be self-righting, in the catastrophic event of overturning.

On the other hand, the hyperboloidal shell as a semi-submersible is simple, without extraneous structure. It is easy to optimize, to analyze, to build, and to repair, and is certainly more reliable than other structures, and could be made self-righting with ease. Also, such shells can be used as the bottles or columns of multi-column structures.

Many of the above features and advantages accrue to the other hyperboloidal structures of this disclosure, such as will be apparent to those of skill in the art.

Figure 41:
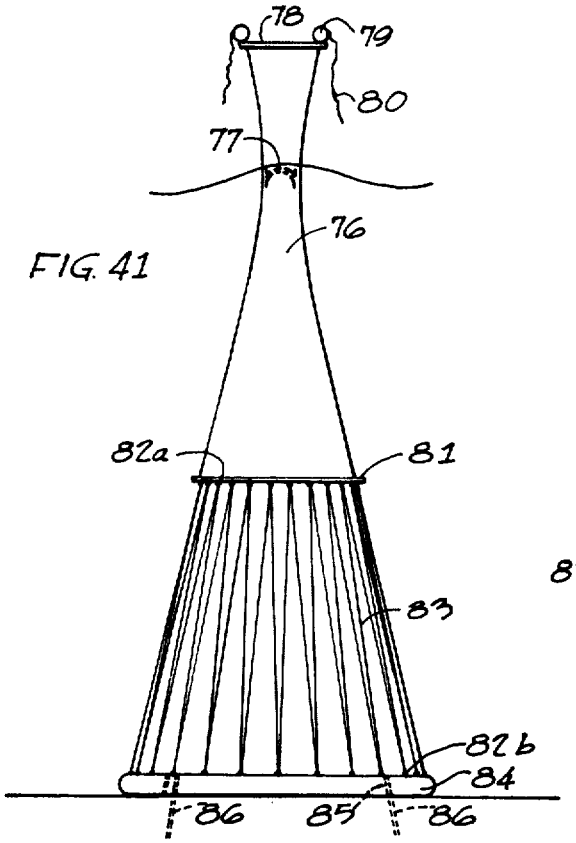
FIGS. 41–44 show a hyperboloidal structural system, combining the functions of jackup, submersible, semi-submersible and fixed platform.
Figure 42:
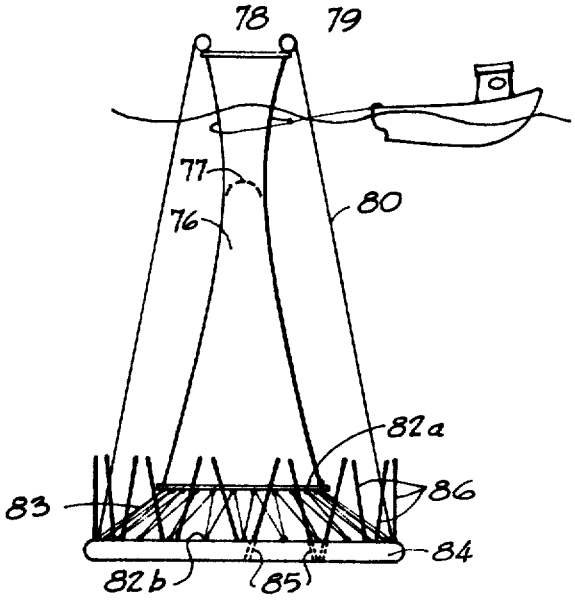
Figure 43:
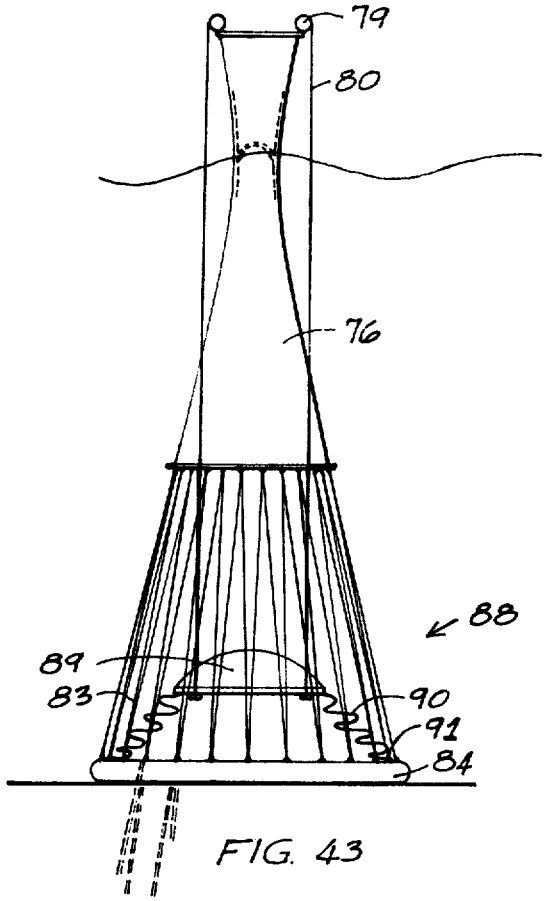
Figure 44:
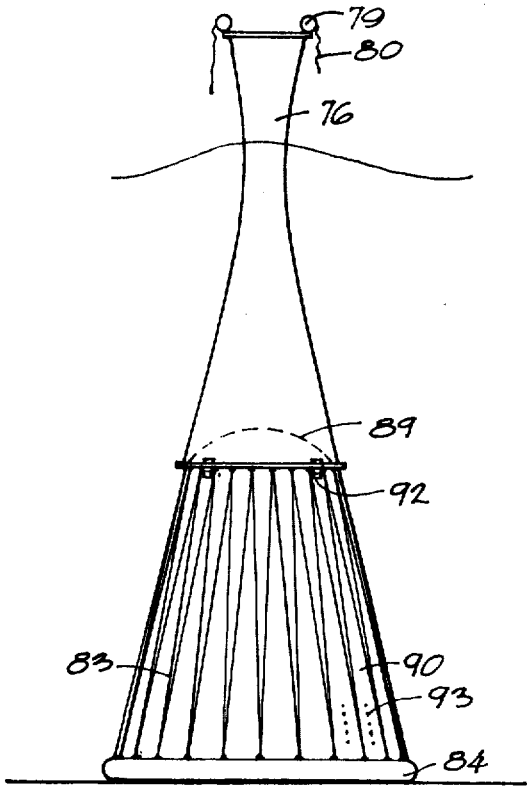

FIGS. 41–44 all show a hyperboloidal shell 76 having a hemispheroidal shell 77 (FIGS. 41 and 43) blocking its throat for buoyancy, placed near the waterline for strength and economy of material. There is a deck structure 78, having a hoist means 79 with hoist cable 80. The shell has a skirt ring 81 with mooring means 82*a*. The means 82*b* have mooring cable means 83 secured thereto in hyperbolic array, and secured at the bottom to an anchor ring 84 having pile sleeves 85 (similar to the means 27, 46, 64, and 63 of FIGS. 13, 23, 34, 37 respectively) for piles 86 in hyperbolic array therethrough. FIGS. 43 and 44 have additional flexible structure 88 to be discussed below.

In FIG. 41, the vessel 76 is made buoyant by air entrapped within the shells 76 and 77. It thereby holds the mooring cable means 83 taut in hyperbolic array, thereby becoming an immobolized platform, stable for operation such as for drilling or prodection. The anchor ring 84 is held by the piles 86 against the forces from above, after the manner of previously disclosed rings of FIGS. 14, 27 and 30, for example.

In FIG. 42, all of the aparatus of FIG. 41 is rearranged for transit. Hoisting means 79 and 80 have drawn up the ring 84 to a position near the bottom of shell 76. Cables 83 have been tautened by means such as are known in the art to prevent dangling. Alternatively, cables 83 could be one and the same as cables 80 or cable means 83 could have been removed; many other alternatives will appear to those skilled in the hoisting and mooring arts.

FIGS. 43 and 44 show the structure of FIG. 41 enhanced by bellows tank means 88 comprising a domical upper ring 89, an accordion-folded center part 90 cemented at its edge 91, at its lower end to the ring 84. Cables 80 draw the bellows means 88 upwards to reach the position, followed by or simultaneous with inflation of the bellows by pump means is contemplated, but in this embodiment the means 80 and 79 are used. The dome 89 may then be secured by connection means 92 to the structure 76, thus converting the whole into a large storage vessel, as for receiving petroleum. A strictly alternative addition shown in the FIG. 44 comprises double thickness or layers of membrane 90 tufted with tuft buttons 93 (or alternatively, quilted) for allowing filling with concrete or other setting plastic for giving structural strength and impermeability. Thus is disclosed a wave-transparent cage of members 83 filled with a bag 90 to conform to the said cage, with plastic hardening means for forming the whole into a rigid structure.

In review, consider that FIGS. 41–44 all show a structural system having advantageous features of the jackup, the submersible, the semi-submersible, and the fixed platform, of the prior art, and more besides. The columnar shell 76 floats like a semi-submersible or jackup to the site at one elevation safe for floating, then is moored at a more advantageous elevation for stationing like a semi-submersible. It is structurally more sound and more stable than a semi-submersible, because it is fixed relative to the marine floor, like a jackup or submersible. It is adapted to be converted from an exploration vehicle into a production facility. It has the ability to leave its foundation ring behind, thereby to act like the separable-leg jackup of the U.S. Pat. No. 3,575,005. It is articulate, like the structure of U.S. Pat. No. 3,716,993.

Figure 46:
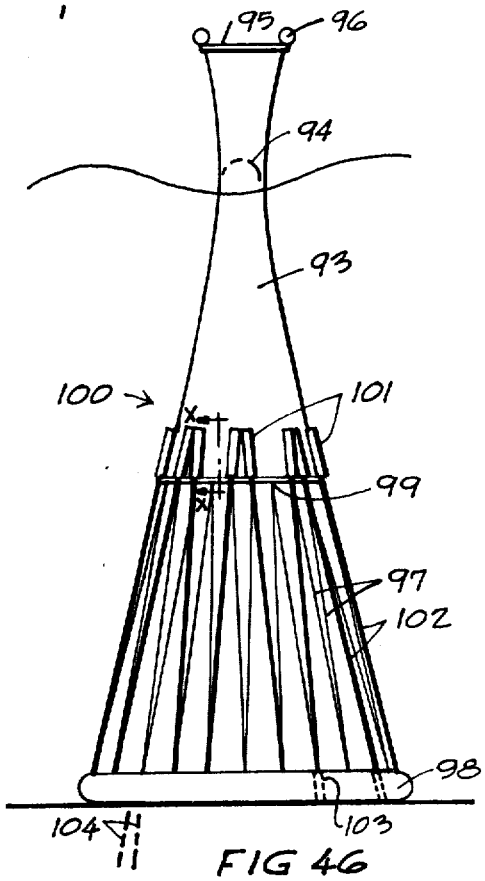
FIG. 46 show a hyperboloidal structural system in conjunction with a mooring structure.

The structure may be rigidified as shown in FIG. 43, or by hollow tubes or hoses (which may be the same as members 83) which are filled with cement or as shown in FIG. 46, discussed below.

Figure 45:
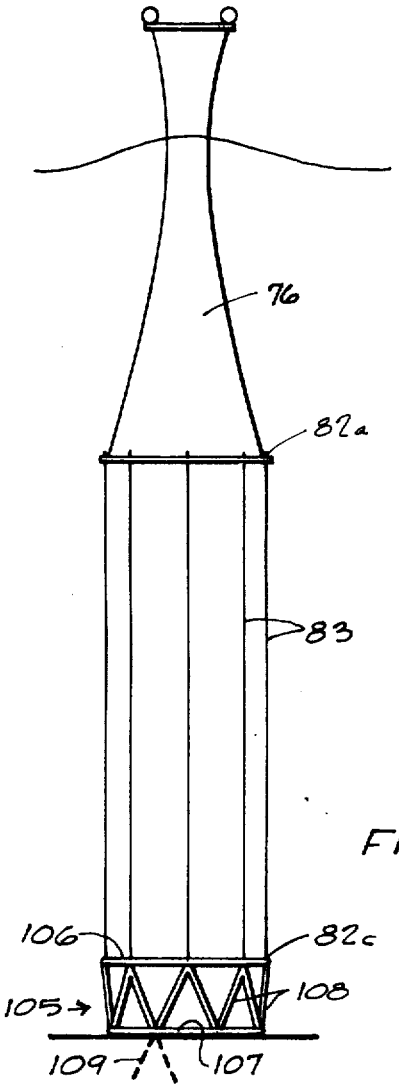
FIG. 45 shows a hyperboloidal structure have alternative stiffening arrangement than FIGS. 41–44.

FIG. 45 shows the shell 76 with all of its permanent parts with a different anchor ring 105 with mooring points 82 for the cables 83, which are now are arranged in parallel. The ring 105 is very much the same as the ring of FIG. 14, with rings 106 and 107 like rings 24 and 25, and members 108 like 27, thus employing a hyperboloidal frame 105 as the anchor ring of the structure, and disclosing additional breadth of the present invention.

Another notable distinction appears between FIG. 41 and 45. In FIG. 45 the cables 83 are parallel, i.e., cylindrical array; in FIG. 41 they are hyperboloidal. The procedures for founding are analogous, but the structural action is different. The cylindrical array allows translation arcuately, and torsionally about the vertical central axis, but inhibits other degrees of freedom. The hyperboloidal array (FIG. 41) inhibits all degrees of freedom. Each has its advantages. In shallow water, for drilling purposes, it is important to have a completely fixed platform, which the hyperboloidal structure of FIG. 41 provides, without great expense of substructure. But extension of the hyperboloidal geometry to deep waters would entail expensive enlargement of the foundation ring, and it is there that arcuate translation has little or no disadvantage in drilling, since the drill string is sufficiently flexible not to be harmed. It is envisioned that convergence of the means 83 to a single anchor point might be sufficient in some instances, but in drilling, maintenance of a level work surface and vertical rig are very important, so the parallel cylindrical array of FIG. 45 is taught to be an optimum arrangement in such conditions.

Figure 47:
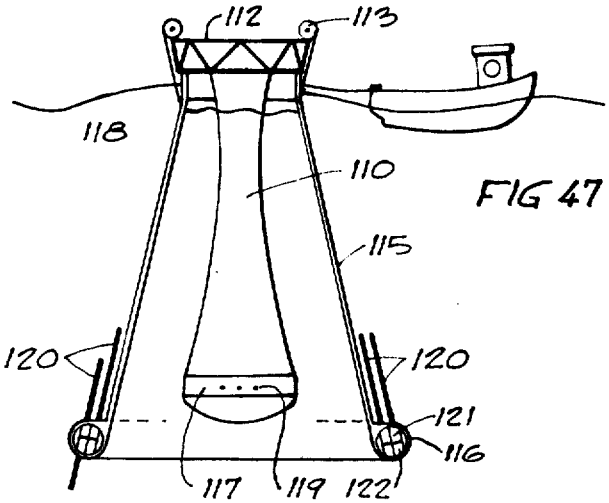
FIGS. 47–48 show a hyperboloidal structure as a jack up apparatus.
Figure 48:
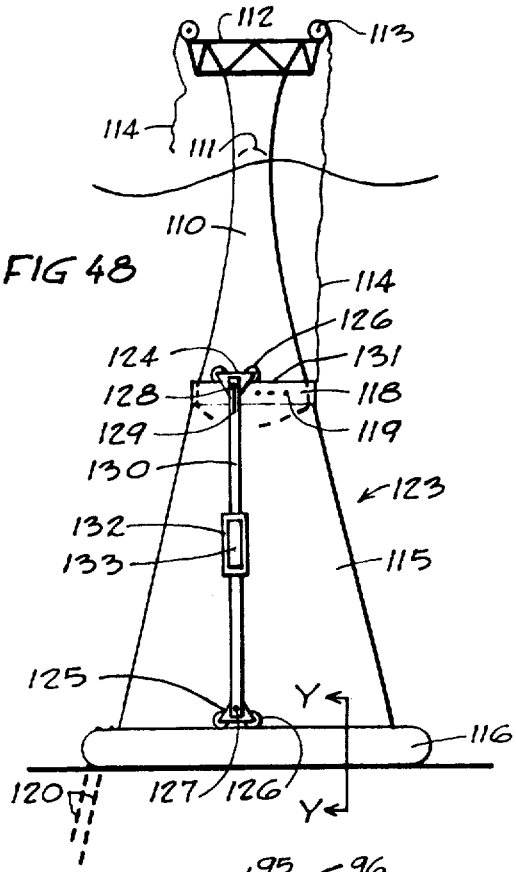

FIGS. 46, 47, and 48 show structure resembling the previous, but with useful novel differences, extending the application. FIG. 46 shows the shell 93 with shell 94 and deck 95 with apparatus 96, all much like means 76, 77, 78, and 79, and with cables 97, moorings 99, and ring 98 much like 83, 87a, and 84 before, with all the other means previously disclosed. But there is new stiffening structure 100 comprising (comparable to the stiffening means 88) nacelle means 101, strut 102, and coupling means 103. Nacelle means 101 is very much the same as the means of FIGS. 32 and 33, with chamber door, seal, and jacket, so that the section x—x (FIG. 46) would show all of the elements of FIG. 32 with the pile 51 corresponding to the strut 102. The differences are limited to these: in FIG. 32 the pile 51 goes directly to the mud. In FIG. 46, the spar 102 is not a pile; the piles 104 were previously driven through the means 103, as in FIG. 41 piles 86 went through means 85, at that time the spars 102 were not in place. They could, alternatively, be simple extensions of the pile, and that is contemplated here where mild conditions allow, but in the situation envisioned, that would defeat the advantage of flexible connection 97 which is that flexibility or articulation frees the upper structure of forces of impact with the piles during stabilization proceedure.

FIGS. 47 and 48 show an upper hyperboloidal shell 110 with shell 111 blocking its throat, a deck 112 with winch means 113 having cables 114. There is a lower hyperbolic shell 115 with anchor ring means 116. The shells 115 and 110 have engagement rings 118 and 117 with bolt means 119 in each. Piles 120 pass through guide means 121 and 122 in ring means 116. The ring means 116 is directly comparable to means 61, 64, and 63 respectively; piles 120 in hyperboloidal array, and the means 116 is not strictly circular in section, but the two systems are analagous Aside from the means set out in the previous paragraph, all of which are analogous to means of the foregoing disclosure, there is new pile foundation apparatus 123 not hitherto disclosed and having great usefullness and broad application. The foundation apparatus 123 comprises an upper carriage 124, a lower carriage 125, the carriages having powered wheels 126 and pivots 127 below and 128 above. Pivot 128 runs in a slot 129 in the lead member 130 while pivot 127 has no slot, but acts like a hinge. The axis of the pivots is normal to the tangent plane through the nearest point of the hyperboloids, and the wheels run on approximately conical treads to minimize the friction of traverse. The traverse 131 of the wheels is circumferential to the hyperboloidal shells 110 and 115.

The means 123 comprises the aforementioned carriage and pivot and traverse apparatus, and also the lead column 130 and pile hammer powered traveler 132 with hammer 133. Pile hoisting means might alternatively ride with the carriages, but in this case no such means ride there.

The apparatus of FIGS. 47 and 48, in brief, is shown in the two FIGS. to operate as a jackup, with shell 110 carrying leg 115 elevated as in FIG. 47 to a station offshore, lowering leg 115 to the marine floor there by means 113–114, as shown in FIG. 48, and then, in a selected sequence, anchoring by means 123 and 116, and securing the upper and lower structures comprising shells 110 and 115 by bolt means 119, thus stabilizing the whole. In selected circumstances, steps may be omitted, for example, the piles might not need be driven, or the bolt means 119 might not be employed, depending on the sea state and duration of stay. In case of desired removal to another station, those skilled in the art will clearly perceive approximate reversal of the steps set out to remove, and repetition of them to return. Likewise it is clear that deballasting will allow the escape of shell 110 from shell 115, accomplishing the ends of the separable leg jackup of the previous disclosure.

It is also clear that one of the shell structures might advantageously be cylindrical or conical, to practice the invention.

It is also clear that shell structures, equipped and operated after the manner disclosed, could be further segmented and that by extreme measures a graduated column of cones or cylinders could sufficiently approximate the structure of the invention, but it would be tedious to elaborate, and clear to those skilled in the art when circumstances warrant.

Now that the general workings of the system of FIGS. 47–48 are disclosed, operation of the apparatus 123 will be discussed. The apparatus 123 in FIG. 150 is positioned over piling 120 for driving downwardly clockwise piling. The powered carriages 124 and 125 operate to index the leads 130, traveler 132, and hammer 133 around the circumference of the shell and over the piles. After the piling has been driven in downward counterclockwise array, the carriages 124 and 125 are powered with 124 traveling counterclockwise relative to carriage 125 to cause pivoting of leads 130 about pivot 127, to bring the apparatus into position for driving piling in downwardly clockwise array. Such pivoting can be alternated as the case requires, until all piles are driven.

Consider the action and advantages of the apparatus 123. It rotates indexedly or swings about the central vertical axis of the entire system, and also rotates or swings indexedly about the axis of pivot 127. Being powered for indexing and positioning, and being submerged, it overcomes the need to have piles reach to the water surface, providing great economy, and allowing a large number of small piles, rather than the usual uneconomical small number of large ones. It is also clear that by means known in the art, such apparatus could be designed for rings such as the rings of the previous figures, and that in some instances rotation about only one of the axes would be sufficient.

The showing of the FIGS. 47–48 is, as was described, of operation as a jackup. It should be noted, however, that extraction of the piles 120 (as by means 113) without release of means 119 will allow the floating array of the whole to operate as a submersible, and the structure is well adapted, as are preceeding structures, to operate as a moored floating structure or semi-submersible.

Figure 49:
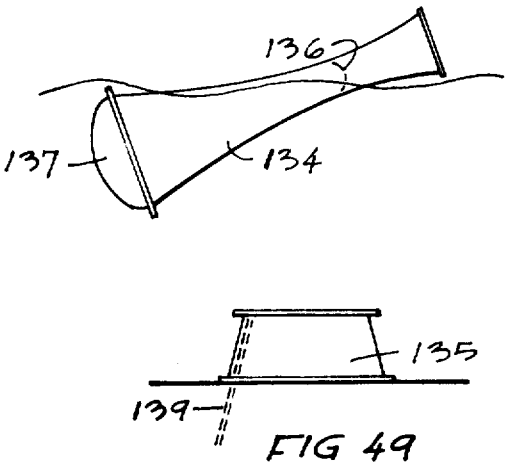
FIGS. 49–50 show a hyperboloidal structure and its stationing at sea.
Figure 50:
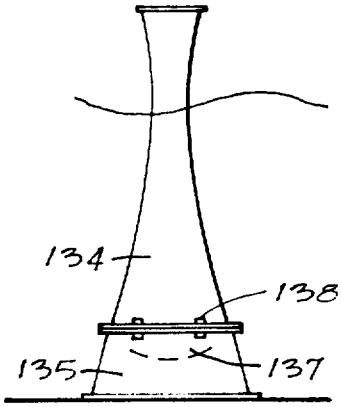

FIGS. 49 and 50 show two stages in the use of other hyperboloidal apparatus. There is hyperboloidal upper structure 134 and lower structure 135, with coupling means 138 and pile means 139 similar to previous hyperboloidal structures. The throat of 134 is however, doubly blocked by hemispheres 136 and 137, thereby allowing dewatering and ballasting of shell 134, causing it to float on its side, adapting it to passage through shallow waters. The structure 135 is preplaced on the marine floor in this instance. The shell 134 is floated, ballasted, and settled into structure 135 and coupled all together by means 138, thus providing a fixed tank station offshore.

Figure 51:
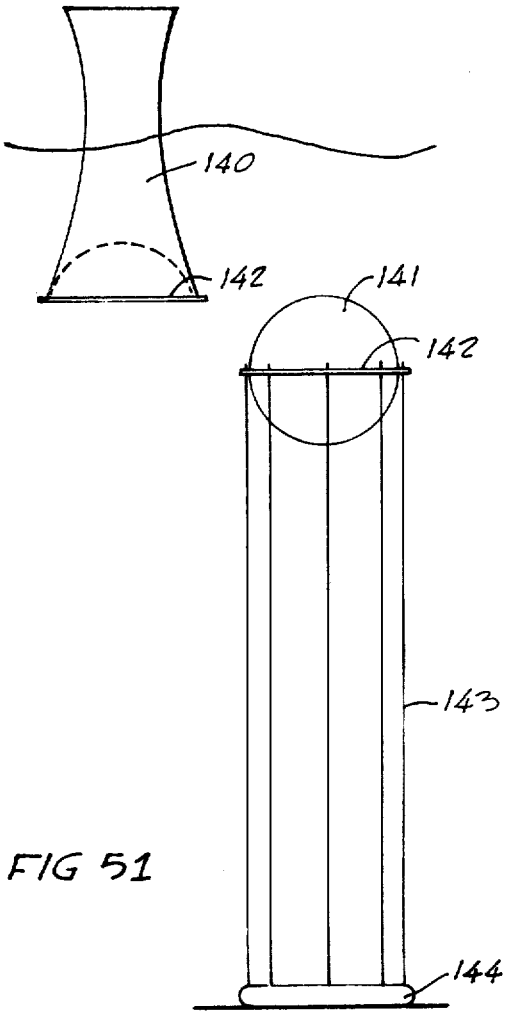
FIGS. 51–52 show an alternative methods of stationing a hyperboloidal structure.

FIG. 51 shows an alternate embodiment of a hyperboloidal structure. There is an upper semi-submersible hyperboloidal shell 140 having ballasting means for changing its floating elevation. There is the moored buoyant vessel 141, with means 142 to mate with the shell 140 and with moorings 143 to the mudline anchor ring 144. The means 142 permits the vessel 141 to support the vessel 140 for stationing, and permits the vessel 140 to carry the vessel 141 and cables 143 and ring 144 for navagating to other stations. The structure 140 is therefore a separable-leg jackup. Further, the vessel 140 is usable (without leg and footing means 141, 143, 144) as a semi-submersible drilling vessel, as by stabilization by thrusters, and may be interchangeable with other such vessels and may interchangeably use other leg means for other depths and circumstances.

Figure 52:
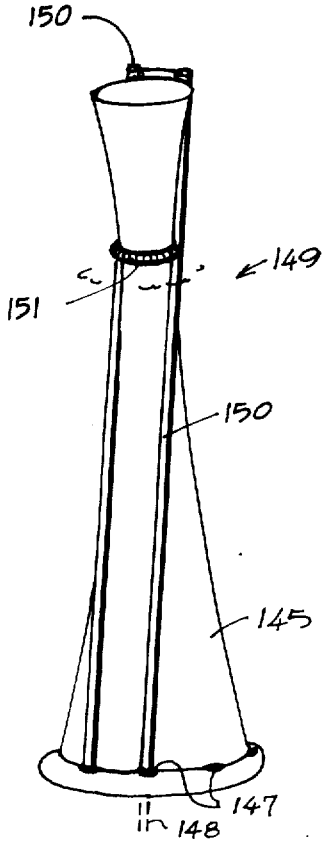

FIG. 52 shows new structure and apparatus which take advantage of the ruled property of the hyperboloidal structure. There is a hyperboloidal shell 145 with ringlike base 146 having guide means 147 therein, aligned with an opening 148 made in the marine floor. There is lead means 149 comprising two leads 150 and rotating collar 151 near the waterline. The leads 150 conform to two parallel rulings on the hyperboloid defining the shell. For each ruling on a hyperboloid of revolution of one sheet, there is one and only one other ruling parallel to it; one or the other of the pair may be brought into coincidence with any selected ruling of the hyperboloid. Following this idea, the collar 151 may be operated to bring the apparatus 149 to such a position as to align one of the leads 150 with any of the guide means 147.

In the prior art, the placement of pile jackets often employs a procedure known as launching, wherein a barge, having a pair of parallel ways spaced to match and carry a pair of parallel legs on the pile jacket, carries the jacket above water by means of the ways supporting said leg pair. Upon reaching the station site, the jacket is "launched", or skidded off the ways to splash into the water and be settled into place. The first purpose of the leads 150 is to serve the purpose of the said leg pair, habilitating certain methods of the prior art to those of the present invention, allowing the shell 145 to be carried on a barge with ways, and launched by the method which will now be clear to those skilled in the art.

But the lead means 149 has two other functions, each important. The operation of the structure of FIG. 52 is as follows: First, the carrying and launching proceedure set out above is followed. With the shell 145 positioned for founding, then the lead means 149 serves as pile or founding leads, for guiding piles and pile setting apparatus, such as a hammer, foundation drill, or pile jet, indexing and guiding around the shell until enough piles are set to serve the foundation purpose, thereby fulfilling its second of three purposes. Next, the leads 150 are positioned by rotation of apparatus 149 to serve as guide means for oil well drilling apparatus, which is the third purpose of apparatus 149.

Numerous variations on the above are apparent; any one or two of the functions may be usefully met by apparatus often the teaching above. For example, the rotary collar might be omitted, resulting in leads fixed movably to the shell, in case only the launching function is to be served, as would be appropriate in case of a semi-submersible hyperboloidal station structure for storage and not for drilling. Such structure would still follow the above teaching.

Considerable variety of novel structure and use has been disclosed; much more could be shown, both in general conformation and in detail, but the principles have been set forth by the illustrative examples and the variations therefrom will be obvious to those of skill in the art, and are contemplated as part of the present invention.

Because of the multiple utilizations of the present shells, e.g., submersible and semi-submersible, the term "para-submersible" may be used to describe the structure.

The invention claime is:

1. An offshore marine structure comprising a pile array receiving means, a pile lead means, movably associated about said pile array receiving means, said pile lead means being pivotally attached for indexing arcuately about an axis, said axis being near the closest approach of the center of said pile array receiving means, means operably associated with said pile lead means for indexing said pile lead means about said pile array receiving means, and submerged pile driving means operatively connected to said pile lead means.

2. The offshore structure according to claim 1 wherein said pile array receiving means comprises a ring having pile receiving means arranged in a hyperboloidal array and said lead means comprises a carriage operating indexedly about said ring.

3. The offshore structure according to claim 2 wherein said pile array receiving means is bipodal having piles associated therein.

4. The offshore structure according to claim 1 wherein said lead means is inclined to conform to the rulings of said hyperboloidal array and comprises a carrier for piles, said array receiving and holding means having nacelle means thereon.

5. The offshore marine structure according to claim 1 wherein said structure is supported by pilings at the marine floor.

6. The offshore structure according to claim 3 wherein said axis is normal to the family of planes containing the bipodal pile array receiving means.

7. The offshore structure according to claim 3 wherein said arcuate axis is parallel to the family of planes containing the bipodal pile array receiving means.

* * * * *